US007676179B2

(12) United States Patent
Hobo et al.

(10) Patent No.: US 7,676,179 B2
(45) Date of Patent: Mar. 9, 2010

(54) WET IMAGE FORMING APPARATUS RECYCLING CARRIER

(75) Inventors: Jumpei Hobo, Osaka (JP); Koji Murase, Osaka (JP); Hiroyuki Ueda, Osaka (JP); Hidenori Takenaka, Osaka (JP); Tomoyuki Oda, Osaka (JP); Nobuhiro Horiuchi, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 178 days.

(21) Appl. No.: 11/822,504

(22) Filed: Jul. 6, 2007

(65) Prior Publication Data

US 2008/0008501 A1 Jan. 10, 2008

(30) Foreign Application Priority Data

Jul. 10, 2006 (JP) ..... 2006-189646
Jul. 10, 2006 (JP) ..... 2006-189647

(51) Int. Cl.
*G03G 15/10* (2006.01)

(52) U.S. Cl. ..... 399/237; 399/57; 399/58; 399/62

(58) Field of Classification Search ..... 399/38, 399/53, 57, 58, 61, 62, 237, 249, 250
See application file for complete search history.

(56) References Cited

U.S. PATENT DOCUMENTS 5,778,289 A * 7/1998 Folkins ..... 399/231
6,856,778 B2 * 2/2005 Vejtasa et al. ..... 399/237
2007/0140738 A1 * 6/2007 Aruga et al. ..... 399/237

FOREIGN PATENT DOCUMENTS

JP 2005-77896 3/2005
JP 2005-315948 11/2005
JP 2007334075 A * 12/2007

* cited by examiner

*Primary Examiner*—David M Gray
*Assistant Examiner*—G. M. Hyder
(74) *Attorney, Agent, or Firm*—Smith, Gambrell & Russell, LLP

(57) ABSTRACT

Of carrier liquids extracted by an carrier liquid extracting device from a liquid developer obtained by mixing together yellow, cyan, magenta, and black liquid developers, the carrier liquid of particularly high purity is recycled for concentration control of the yellow liquid developer and the carrier liquid of purity a little lower than the aforementioned purity is recycled for concentration control of the cyan, magenta, and black liquid developers. A carrier liquid extracted from the yellow liquid developer is recycled for the concentration control of the yellow liquid developer, and a carrier liquid extracted from the liquid developer obtained by mixing together the cyan, magenta, and black liquid developers is recycled for the concentration control of the cyan, magenta, and black liquid developers. This permits efficient use of carrier liquids to be recycled without having an influence on the image quality.

7 Claims, 6 Drawing Sheets

WET IMAGE FORMING APPARATUS RECYCLING CARRIER

This application is based on Japanese Patent Application No. 2006-189646 filed on Jul. 10, 2006 and Japanese Patent Application No. 2006-189647 filed on July 10, the contents of which are hereby incorporated by reference.

BACKGROUND OF THE INVENTION

1. Field of the Invention

The present invention relates to a wet image forming apparatus for developing an electrostatic latent image by using liquid developers of a plurality of colors to thereby form a color image.

2. Description of Related Art

In electrophotographic image forming apparatuses, it is predominant practice to transfer an electrostatic latent image formed on a photosensitive drum by using a powdery developer. An image forming apparatus has been recently proposed which forms an image through development by using a liquid developer in which toner particles are dispersed in a carrier liquid. Known as such a wet image forming apparatus is, for example, an image forming apparatus as disclosed in patent document 1 which forms color images by using liquid developers of mutually different colors, for example, black, magenta, cyan, and yellow, and then sequentially transfers these color images to thereby form a full-color image.

It is known that, as disclosed in patent document 2 for example, for liquid developers of a wet image forming apparatus as described above, only a carrier liquid is extracted by using a carrier recycling device from the used liquid developer and then recycled.

[Patent Document 1] JP-A-No. 2005-315948

[Patent Document 2] JP-A-No. 2005-77896

In a wet image forming apparatus as described above, a liquid developer whose concentration is controlled to a desired level by mixing a carrier liquid with a condensed liquid developer or the like is supplied to a photosensitive drum. At this point of time, it is possible, as disclosed in patent document 2, to use carrier liquids to be recycled as the carrier liquids used for the concentration control.

When the carrier liquid to be recycled is used, it is preferable that the carrier liquids be extracted from the used liquid developers of different colors (for example, black, cyan, magenta, and yellow) all at a time in order to increase the amount of carrier liquid extracted. That is, the liquid developers of the different colors are once mixed together and then the carrier liquid to be recycled is extracted from the mixed liquid developer.

However, a carrier liquid extracting device usually used has difficulties in completely removing toner particles from the used liquid developers of the different colors, thus leaving the toner particles, although small in amount, in the extracted carrier liquid. The use of such carrier liquid extracted from the mixed liquid developers possibly results in a phenomenon that the toner particles of the other colors appear outstanding in, for example, the yellow liquid developer. This therefore involves a problem that color reproducibility becomes unstable at the time of image formation.

SUMMARY OF THE INVENTION

The present invention addresses the problem described above, and it is an object of the invention to provide a wet image forming apparatus free from deterioration in the quality of a formed image even by use of a recycled carrier liquid.

To achieve the problem described above, according to one aspect of the invention, a wet image forming apparatus including a plurality of photoconductors and forming, by using liquid developers of a plurality of colors, images of the mutually different colors on the respective photoconductors, includes: a plurality of collectors for collecting the liquid developers remaining on the respective photoconductors; a carrier liquid extracting device for extracting a carrier liquid from a liquid developer obtained by mixing together all the liquid developers collected by the respective collectors; and a carrier liquid purity detector for detecting purity of the carrier liquid extracted by the carrier liquid extracting device. The carrier liquid extracted by the carrier liquid extracting device is recycled as a carrier liquid for concentration control of the liquid developers. Based on the purity detected by the carrier liquid purity detector, it is determined for the concentration control of which of the liquid developers of the plurality of colors the carrier liquid extracted by the carrier liquid extracting device is used.

With the configuration described above, as the carrier liquids to be recycled, carrier liquids of purity equal to or larger than predetermined purity extracted by the carrier liquid extracting device are used. Of these carrier liquids, the carrier liquid of particularly high purity can be used for the concentration control of the liquid developer of the color susceptible to the influence of toner particles of the other colors and the carrier liquid of purity a little lower than the aforementioned purity can be used for the concentration control of the liquid developer less susceptible to the influence of the other colors. This permits efficient use of the carrier liquids to be recycled without having an influence on the image quality. Therefore, favorable image quality can be provided even by use of the carrier liquids to the recycled.

Here, as the carrier liquids to be recycled, for example, carrier liquids having an impurity concentration of 0.5% or less can be used. Of these carrier liquids, the carrier liquid having, for example, an impurity concentration of 0.1% or less can be used for the concentration control of the liquid developer of the color susceptible to the influence of the toner components of the other colors. Moreover, the carrier liquid having, for example, an impurity concentration of 0.05% or less may be used for the concentration control of the liquid developer susceptible to the influence of the toner components of the other colors.

In the wet image forming apparatus, the liquid developers of the plurality of colors may include yellow, cyan, magenta, and black liquid developers, and the carrier liquid extracted by the carrier liquid extracting device is used for the concentration control of the yellow liquid developer if the purity detected by the carrier liquid purity detector is equal to or larger than a predetermined value and may be used for the concentration control of any of the cyan, magenta, and black liquid developers if the purity detected by the carrier liquid purity detector is less than the predetermined value.

With the configuration described above, a carrier liquid of particularly high purity is used for the concentration control of the yellow liquid developer susceptible to the influence of the other colors, and a carrier liquid of purity a little lower than the aforementioned purity is used for the concentration control of the black, cyan, and magenta liquid developers less susceptible to the influence of the other colors. This permits efficient use of the carrier liquids to recycled without having an influence on the image quality.

According to another aspect of the invention, a wet image forming apparatus including a plurality of photoconductors and forming, by using liquid developers of a plurality of colors, images of the mutually different colors on the respective photoconductors includes: a plurality of collectors for collecting the liquid developers remaining on the respective photoconductors; a carrier liquid extracting device for extracting a carrier liquid from a liquid developer obtained by mixing together all the liquid developers collected by the respective collectors; and a carrier liquid purity detector for detecting purity of the carrier liquid extracted by the carrier liquid extracting device. The carrier liquid extracted by the carrier liquid extracting device is recycled as a carrier liquid for concentration control of the liquid developers or as a carrier liquid for cleaning of a member. Based on the purity detected by the carrier liquid purity detector, it is determined whether the carrier liquid extracted by the carrier liquid extracting device is used for the concentration control of the liquid developers or for the cleaning of the member.

With the configuration described above, as the carrier liquids to be recycled, carrier liquids of high purity extracted by the carrier liquid extracting device are used. Of these carrier liquids, the carrier liquid of particularly high purity can be used for, for example, cleaning of a photoconductor collecting blade as the collector and the carrier liquid of purity a little lower than the aforementioned purity can be used for the concentration control of the liquid developers of the colors less susceptible to the influence of the other colors. More specifically, the carrier liquid of not very high purity is used for the concentration control of the black, cyan, and magenta liquid developers. This permits efficient use of the carrier liquids to be recycled without having influence on the image quality. Therefore, favorable image quality can be provided even by use of the carrier liquids to be recycled.

Here, as the carrier liquids to be recycled, carrier liquids having for example, an impurity concentration of 0.5% or less can be used. Of these carrier liquids, the carrier liquid having, for example, an impurity concentration of 0.1% or less can be used for the cleaning of the collector. Moreover, the carrier liquid having, for example, an impurity concentration of 0.05% or less may be used for the cleaning of the collector.

According to still another object of the invention, a wet image forming apparatus including a plurality of photoconductors and forming, by using liquid developers of a plurality of colors including yellow, images of the mutually different colors on the respective photoconductors and then sequentially superimposing the images of the plurality of colors on one another to thereby achieve image formation includes: a plurality of collectors for collecting the liquid developers remaining on the respective photoconductors; a yellow carrier liquid extracting device for extracting a carrier liquid from the yellow liquid developer collected from the yellow photoconductor included in the photoconductors; and an other color carrier liquid extracting device for extracting a carrier liquid from the liquid developers collected from all the other photoconductors excluding the yellow photoconductor. The carrier liquid extracted by the yellow carrier liquid extracting device is recycled for concentration control of the yellow liquid developer, and the carrier liquid extracted by the other color carrier liquid extracting device is recycled for concentration control of the liquid developers of the colors excluding yellow. The image formed on the yellow photoconductor is transferred onto the photoconductor earlier than the images formed on the other photoconductors.

With the configuration described above, the carrier liquid extracted form the yellow liquid developer is used for the concentration control of the same yellow liquid developer susceptible to the influence of the toner particles of the other colors, but the carrier liquid extracted from the liquid developers of the other colors is not used for the concentration control of the yellow liquid developer. On the other hand, the carrier liquid extracted from the liquid developer obtained by mixing together the liquid developers of the other colors is used for the concentration control of the liquid developers of the aforementioned other colors. This permit efficient use of the carrier liquids to be recycled without having an influence on the image quality. Therefore, favorable image quality can be provided even by use of the carrier liquids to be recycled. Moreover, the image formed on the yellow photoconductor is transferred first, which permits preventing the carrier liquid extracted from the used yellow liquid developer from being mixed with the toner particles of the liquid developers of the other colors.

According to still another aspect of the invention, a wet image forming apparatus including a plurality of photoconductors and forming, by using liquid developers of a plurality of colors including yellow, images of the mutually different colors on the respective photoconductors and then sequentially superimposing the images of the plurality of colors on one another to thereby achieve image formation includes: a plurality of collectors for collecting the liquid developers remaining on the respective photoconductors; a yellow carrier liquid extracting device for extracting a carrier liquid from the yellow liquid developer collected from the yellow photoconductor included in the photoconductors; and an other color carrier liquid extracting device for extracting a carrier liquid from the liquid developers collected from all the other photoconductors excluding the yellow photoconductor. The carrier liquid extracted by the yellow carrier liquid extracting device is used and recycled for cleaning of a member, and the carrier liquid extracted by the other color carrier liquid extracting device is recycled for concentration control of the liquid developers of the colors excluding yellow. The image formed on the yellow photoconductor may be transferred onto the photoconductor earlier than the images formed on the other photoconductors.

With configuration described above, for example, a carrier liquid of high purity is required for cleaning of a photoconductor collecting blade as the collector, but the carrier liquid extracted from the yellow liquid developer can be used for the cleaning of this photoconductor collecting blade. On the other hand, the carrier liquid extracted from the liquid developer obtained by mixing together the other colors excluding yellow is used for the concentration control of the liquid developers of the other colors excluding yellow. This permits efficient use of the carrier liquids to be recycled without having an influence on the image quality. Therefore, favorable image quality can be provided by use of the carrier liquids to be recycled. Moreover, the image formed on the yellow photoconductor is transferred first, so that the liquid developers of the other colors do not adhere to the yellow photoconductor. This therefore permits preventing the carrier liquid extracted from the used yellow liquid developer from being mixed with the toner particles of the liquid developers of the other colors.

The objects of the invention described above and other objects thereof are more clarified with reference to preferred embodiments described below and also the accompanying drawings.

DETAILED DESCRIPTION OF PREFERRED EMBODIMENTS

First Embodiment

The first embodiment of the present invention will be described, with reference to FIGS. 1, 2A, and 2B.

Figure 1:
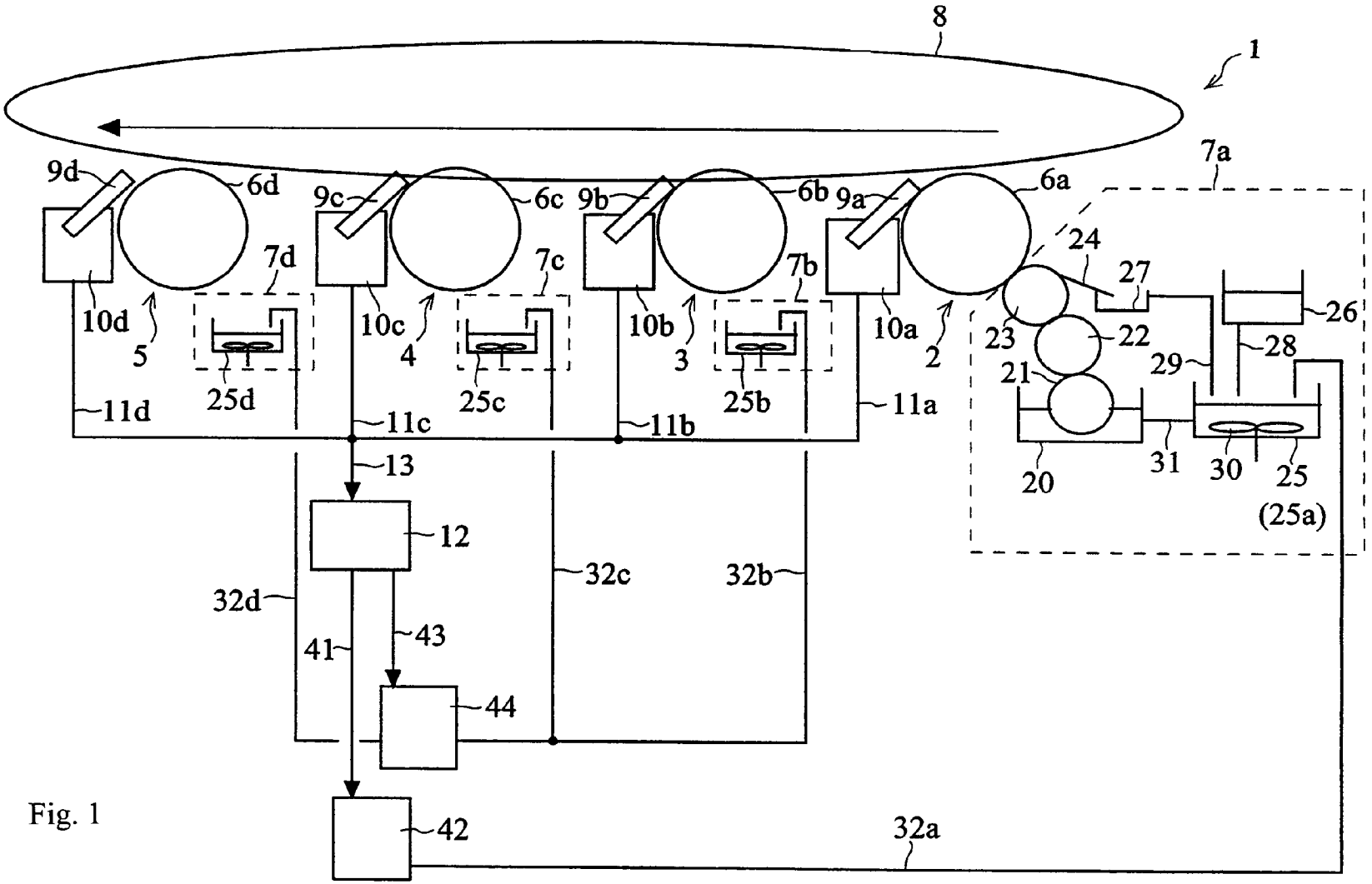
FIG. 1 is a schematic diagram showing configuration of a wet image forming apparatus according to a first embodiment of the present invention.

FIG. 1 is a schematic diagram showing configuration of a wet image forming apparatus according to the first embodiment of the invention. FIG. 2A is a schematic diagram showing configuration of a carrier liquid extracting device of the wet image forming apparatus according to this embodiment shown in FIG. 1. FIG. 2B is a plan view as viewed from the top showing configuration of a carrier liquid box and an impurity concentration sensor both included in the carrier liquid extracting device shown in FIG. 2A.

The wet image forming apparatus 1 according to the first embodiment of the invention forms a full-color image, and includes a first image forming mechanism 2, a second image forming mechanism 3, a third image forming mechanism 4, and a fourth image forming mechanism 5. These image forming mechanisms 2 to 5 are formed for yellow (Y), cyan (C), magenta (M), and black (BK), respectively, as viewed from the right in FIG. 1, and are composed of units with configuration in substantially common with each other.

The image forming mechanisms 2 to 5 respectively include: photoconductive drums 6*a*, 6*b*, 6*c*, and 6*d* as cylindrical photoconductors and liquid developing devices 7*a*, 7*b*, 7*c*, and 7*d* which supply liquid developers of colors (yellow, cyan, magenta, and black) respectively corresponding to the photoconductive drums 6*a* to 6*d* to develop electrostatic latent images formed on the surfaces of the respective photoconductive drums 6*a* to 6*d*. The photoconductive drums 6*a* to 6*d* are arranged so that the yellow photoconductive drum 6*a*, the cyan photoconductive drum 6*b*, the magenta photoconductive drum 6*c*, and the black photoconductive drum 6*d* are located in the order just mentioned as viewed from the right of FIG. 1. The photoconductive drums 6*a* to 6*d* are arranged at fixed intervals from each other, and each rotates in a given direction at the time of image formation.

The wet image forming apparatus 1 further includes an endless intermediate transfer belt 8 on which toner images of different colors respectively formed on the surfaces of the photoconductive drums 6*a* to 6*d* are temporarily transferred. The intermediate transfer belt 8 rotates along a line indicated by a left-pointing arrow in FIG. 1, and the toner images of the different colors are sequentially superimposed on the intermediate transfer belt 8. The toner images of the different colors temporarily transferred on the intermediate transfer belt 8 are transferred onto paper by a secondary transfer roll, not shown. The toner images transferred on the paper are heated and pressurized by a fixing device, not shown, whereby a full color toner image is fixed on the paper.

The image forming mechanisms 2 to 5 include photoconductive drum collecting blades 9*a*, 9*b*, 9*c*, and 9*c*, respectively, for scraping residual liquid developers remaining on the surfaces of the photoconductive drums 6*a* to 6*d* after toner images have been transferred onto the intermediate transfer belt 8. The residual liquid developers scraped by the photoconductive drum collecting blades 9*a* to 9*d* are collected by collecting boxes 10*a*, 10*b*, 10*c*, and 10*d*, respectively, and then recycled as described later.

The liquid developing devices 7*a* to 7*d* have configuration in common with each other. The description of the first embodiment of the invention refers to the yellow liquid developing device 7*a* as an example. The configuration of the other liquid developing devices 7*b*, 7*c*, and 7*d* is the same as that of the liquid developing device 7*a*, and thus omitted from the description.

The liquid developing device 7*a* includes: a supply pot 20 storing a liquid developer; a supply roller 21 for drawing the liquid developer from the supply pot 20; an application roller 22 for making contact with the peripheral surface of the supply roller 21 and then applying the liquid developer drawn by the supply roller 21 to a developing roller 23; and the developing roller 23 for making contact with the surface of the photoconductive drum 6*a* and then supplying the liquid developer to the photoconductive drum 6*a*.

The supply roller 21 is placed into the supply pot 20 and soaked in the liquid developer stored in the supply pot 20. The liquid developer in the supply pot 20, which has great wettability, is drawn by the rotation of the supply roller 21 and then supplied to the surface of the photoconductive drum 6*a* via the application roller 22 and the developing roller 23. On the developing roller 23, a developing roller collecting blade 24 is arranged which scrapes the liquid developer remaining on the surface of the developing roller 23 after an image is formed on the surface of the photoconductive drum 6*a*.

Further, the liquid developing device 7*a* includes: a preparation pot 25 (25*a*) for storing a liquid developer while controlling the liquid developer to provide an appropriate range of toner particle concentration for the purpose of supplying the liquid developer to the supply pot 20; a toner pot 26 storing a concentrated liquid developer having a relatively high toner particle concentration for the purpose of supplying the liquid developer to the preparation pot 25 (25*a*); and a collection pot 27 for storing the liquid developer scraped by the developing roller collecting blade 24. The concentrated liquid developer is supplied from the toner pot 26 to the preparation pot 25 (25*a*) through a developer conveyance path 28.

The liquid developer collected from the developing roller 23 is used for development again. At this point of time, the liquid developer collected from the developing roller 23 has a large number of toner particles remaining under the influence of heat and the like generated upon the development and thus has high toner particle concentration. The collected liquid developer stored in the collection pot 27 is supplied to the preparation pot 25 (25*a*) through a collected developer conveyance path 29.

To the preparation pot 25 (25*a*), a carrier liquid for diluting a liquid developer is supplied through a carrier liquid conveyance path 32*a*. That is, in the preparation pot 25 (25*a*), the condensed liquid developer supplied from the toner pot 26 and the collected liquid developer supplied from the collection pot 27 are diluted by the carrier liquid. In this condition, the toner particle concentration of the liquid developer in the preparation pot 25 (25*a*) is maintained at the appropriate range by feedback control. On the bottom of the preparation pot 25 (25*a*), an agitating blade 30 is installed, which performs agitation so that the toner particle concentration becomes uniform in the preparation pot 25 (25*a*).

The preparation pot 25 (25*a*) is connected to the supply pot 20 via a conveyance path 31, so that the liquid developer controlled to have appropriate concentration in the preparation pot 25 (25*a*) is supplied to the supply pot 20.

In the embodiment described above, the carrier liquid provided to the preparation pot 25 (25*a*) is a carrier liquid to be recycled. That is, after the liquid developers collected from the respective collecting boxes 10*a* to 10*d* are mixed together, only carrier liquid components are extracted from the mixture and then provided to the preparation pots 25*a* to 25*d* of the respective liquid developing devices 7*a* to 7*d* as a carrier liquid for dilution, that is, concentration control.

Of the carrier liquids extracted from the liquid developer, the carrier liquid of particularly high purity (with an impurity concentration of 0.1% or less) is supplied to the preparation pot 25*a* of the yellow liquid developing device 7*a*. On the other hand, of the carrier liquids extracted from the liquid developer, the carrier liquid of relatively less high purity (with an impurity concentration of between 0.1% exclusive and 0.5% inclusive) is supplied to the preparation pots 25*b*, 25*c*, and 25*d* of the cyan, magenta, and black liquid developing devices 7*b*, 7*c*, and 7*d*. In this embodiment, the term "purity" denotes the concentration of impurities contained in a carrier liquid extracted by carrier liquid extracting means. That is, high purity of the carrier liquid results in small impurity concentration. This purity of the carrier liquid can be expressed by the transparency of the carrier liquid detected by an optical method. Therefore, the detection of the transparency of the carrier liquid permits detection of the impurity concentration, that is, the amount of residual toner which is expected to have an influence on the image quality.

More specifically, the liquid developers of the different colors collected in the four collecting boxes 10*a* to 10*d* respectively pass through conveyance paths 11*a*, 11*b*, 11*c*, and 11*d*, then are merged together into an assembly path 13, and then supplied to a carrier liquid extracting device 12 while all kept mixed together. From the carrier liquid extracting device 12, carrier liquids of high purity (with an impurity concentration of 0.5% or less) are extracted. Of these carrier liquids, the carrier liquid of particularly high purity (with an impurity concentration of 0.1% or less) passes through a conveyance path 41, and then is conveyed to and stored in a first carrier liquid pot 42. On the other hand, the carrier liquid of a little lower purity (with an impurity concentration of between 0.1% exclusive and 0.5% inclusive) passes through a conveyance path 43, and then is conveyed to and stored in a second carrier liquid pot 44.

The first carrier liquid pot 42 is connected to the preparation pot 25*a* of the yellow liquid developing device 7*a* via the carrier liquid conveyance path 32*a*, so that the carrier liquid stored in the first carrier liquid pot 42 is supplied to the yellow preparation pot 25*a*. On the other hand, the second carrier liquid pot 44 is connected to the cyan, magenta, and black preparation pots 25*b*, 25*c*, and 25*d* via a carrier liquid conveyance path 32*b*, a carrier liquid conveyance path 32*c*, and a carrier liquid conveyance path 32*d*, respectively, so that the carrier liquid stored in the second carrier liquid pot 44 is supplied to the cyan, magenta, and black preparation pots 25*b*, 25*c*, and 25*d*.

Of these liquid developers of the four colors, the yellow liquid developer is susceptible to the influence of the toners of the other colors. Thus, for concentration control of the yellow liquid developer, the carrier liquid of particularly high purity is used. On the other hand, when compared to the yellow liquid developer, the liquid developers of the other colors, black, cyan, and magenta, are less susceptible to the influence of the other colors. That is, the use of the carrier liquid of not very high purity for the concentration control of these liquid developers has little influence on the image quality. Therefore, the carrier liquid of slightly lower purity is used for the concentration control of the black, cyan, and magenta liquid developers.

Next, the carrier liquid extracting device according to the first embodiment of the invention will be described. FIG. 2A is a schematic diagram showing configuration of the carrier liquid extracting device of the wet image forming apparatus according to the first embodiment of the invention shown in FIG. 1. FIG. 2B is a plan view as viewed from the top showing configuration of the carrier liquid box and the impurity concentration sensor both included in the carrier liquid extracting device shown in FIG. 2A.

The carrier liquid extracting device 12 includes: a storage container 60 for storing liquid developers supplied from the collecting boxes 10*a*, 10*b*, 10*c*, and 10*d*; a lower roller 61 for drawing the liquid developer from the storage container 60; and an upper roller 62 which is arranged above the lower roller 61 in such a manner as to make contact with the peripheral surface of the lower roller 61 and which separates the liquid developer into toner particles and carrier liquid components.

The lower roller 61 and the upper roller 62 are respectively fitted with cores 61*a* and 62*a* of metal and rotatable about these cores 61*a* and 62*a*. To the core 62*a* of the upper roller 62, a positive-charge bias of 200V is applied. The core 61*a* of the lower roller 61 is grounded. The upper roller 62 and the lower roller 61 have conductive property. For example, the upper roller 62 and the lower roller 61 may be each formed of a metal roller or a conductive rubber roller.

Figure 2A:
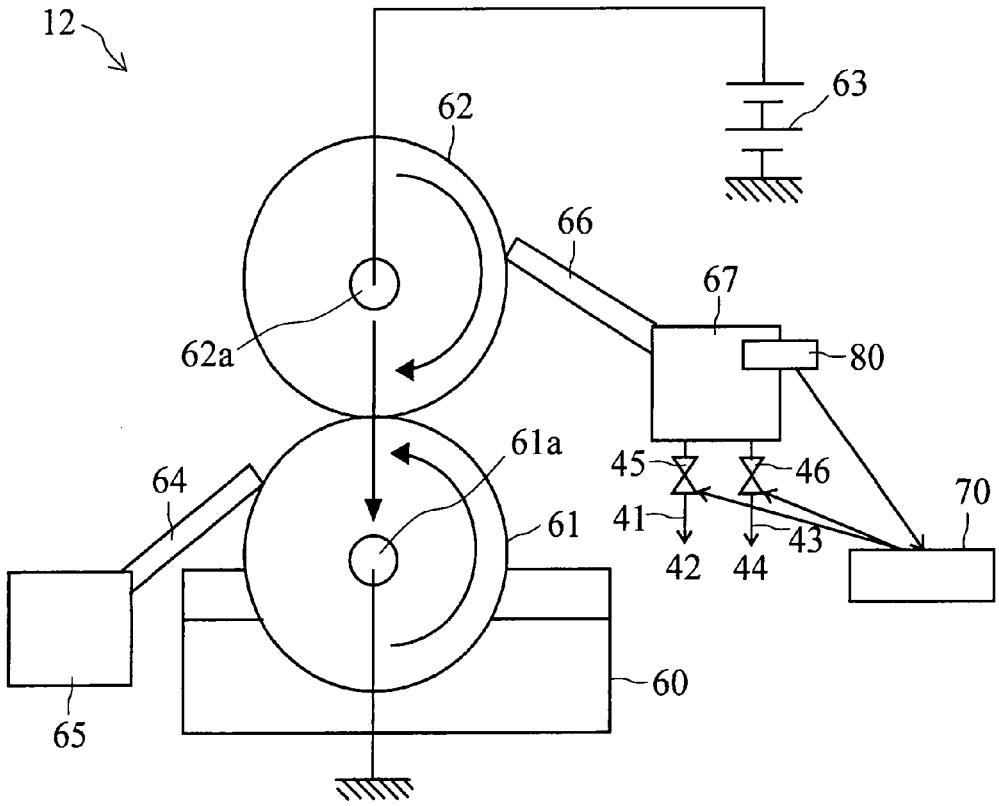
FIG. 2A is a schematic diagram showing configuration of a carrier liquid extracting device of the wet image forming apparatus according to the first embodiment of the invention shown in FIG. 1.
Figure 2B:
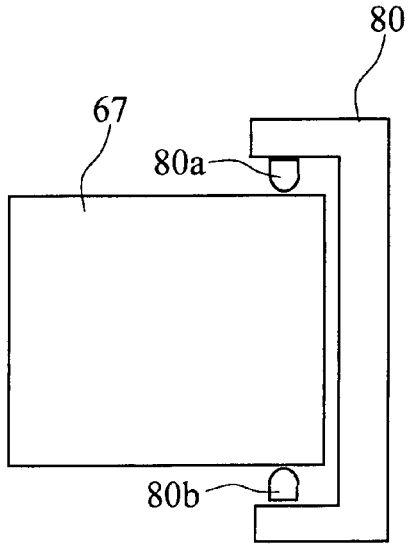
FIG. 2B is a plan view as viewed from the top showing configuration of a carrier liquid box and an impurity concentration sensor both included in the carrier liquid extracting device shown in FIG. 2A.

The lower roller 61 and the upper roller 62 are individually driven into rotation, and rotate respectively in directions of arrows shown in FIG. 2A. The lower roller 61 is soaked in the liquid developer stored in the storage container 60 in such a state that the lower half of the lower roller 61 is placed in the storage container 60.

The liquid developer, which has great wettability, adheres to the peripheral surface of the lower roller 61. The liquid developer adhering to the lower roller 61 adheres, at a contact point between the lower roller 61 and the upper roller 62, to the peripheral surface of the upper roller 62. As shown in FIG. 2A, the contact point between the lower roller 61 and the upper roller 62 lies on a line linking together the cores 61*a* and 61*b* of the both rollers 61 and 62. To this contact point, the positive-charge bias is applied from the upper roller 62. The toner particles in the liquid developer are positively charged, and thus have property repelling the positive charge. Therefore, of the liquid developer adhering to the lower roller 61, the toner particles do not adhere to the positively charged upper roller 62, and only the carrier liquid components of the liquid developer adhere to the upper roller 62, thus forming a thin film of the carrier liquid on the peripheral surface of the upper roller 62.

On the upper roller 62, a carrier liquid collecting blade 66 for scraping the carrier liquid adhering to the peripheral surface of the upper roller 62 is arranged. The carrier liquid collecting blade 66 is formed of, for example, a urethane blade. The carrier liquid scraped by the carrier liquid collecting blade 66 is collected in a carrier liquid box 67.

In the carrier liquid box 67, an impurity concentration sensor 80 as a carrier liquid purity detector for detecting the purity of the carrier liquid is arranged, which detects the concentration of impurities contained in the carrier liquid. This impurity concentration sensor 80 is formed of, for example, a transmission-type optical sensor. This impurity concentration sensor 80 is provided with: as shown in FIG. 2B, a light emitting element 80*a* which emits light; and a light receiving element 80*b* which receives the light irradiated from the light emitting element 80*a*. The light irradiated from the light emitting element 80*a*, in the presence of impurities between the light emitting element 80*a* and the light receiving element 80*b*, is blocked by these impurities, thus resulting in a decrease in the mount of light entering the light receiving element 80*b* and thus a decrease in output current. In this manner, the impurity concentration sensor 80 measures the concentration of impurities by converting a change in the amount of light irradiated from the light emitting element 80*a* to the light receiving element 80*b* (depending on the concentration of impurities) into an electrical signal.

The wet image forming apparatus 1 according to the first embodiment of the invention detects the purity of the carrier liquid by detecting the concentration of impurities contained in the carrier liquid with the impurity concentration sensor 80. This impurity concentration sensor 80 is connected to a controller 70 composed of, for example, a CPU, a RAM, a ROM, and the like, so that the impurity concentration detected by the impurity concentration sensor 80 is inputted to the controller 70. In the invention, the controller 70 may be provided separately from or inside a main controller of the wet image forming apparatus 1.

The carrier liquid box 67 is connected to the first carrier liquid pot 42 and the second carrier liquid pot 44 via the conveyance path 41 and the conveyance path 43, respectively. On the conveyance path 41 and the conveyance path 43, valves 45 and 46 are respectively disposed. The valves 45 and 46 are each connected to the controller 70, and it is configured such that opening and closing of the valves 45 and 46 can be switched based on a control signal of the controller 70.

If the concentration detected by the impurity concentration sensor 80 is 0.1% or less, the controller 70 opens only the valve 45 while closing the valve 46. As a result, the carrier liquid stored in the carrier liquid box 67 is supplied to the first carrier liquid pot 42 through the conveyance path 41. On the other hand, if the concentration detected by the impurity concentration sensor 80 is between 0.1% exclusive and 0.5% inclusive, the controller 70 opens only the valve 46 while closing the valve 45. As a result, the carrier liquid stored in the carrier liquid box 67 is supplied to the second carrier liquid pot 44 through the conveyance path 43.

The carrier liquid components and toner particles not adhering to the upper roller 62 but remaining on the lower roller 61 are scraped by a cleaning blade 64, collected in a toner box 65, and then discarded.

As described above, according to the first embodiment of the invention, a carrier liquid of particularly high purity is used for the concentration control of the yellow liquid developer susceptible to the influence of the other colors, while a carrier liquid of little lower purity is used for the concentration control of the black, cyan, and magenta liquid developers less susceptible to the influence of the other colors. This permit efficient use of the carrier liquids to be recycled without having an influence on the image quality.

Second Embodiment

Figure 3:
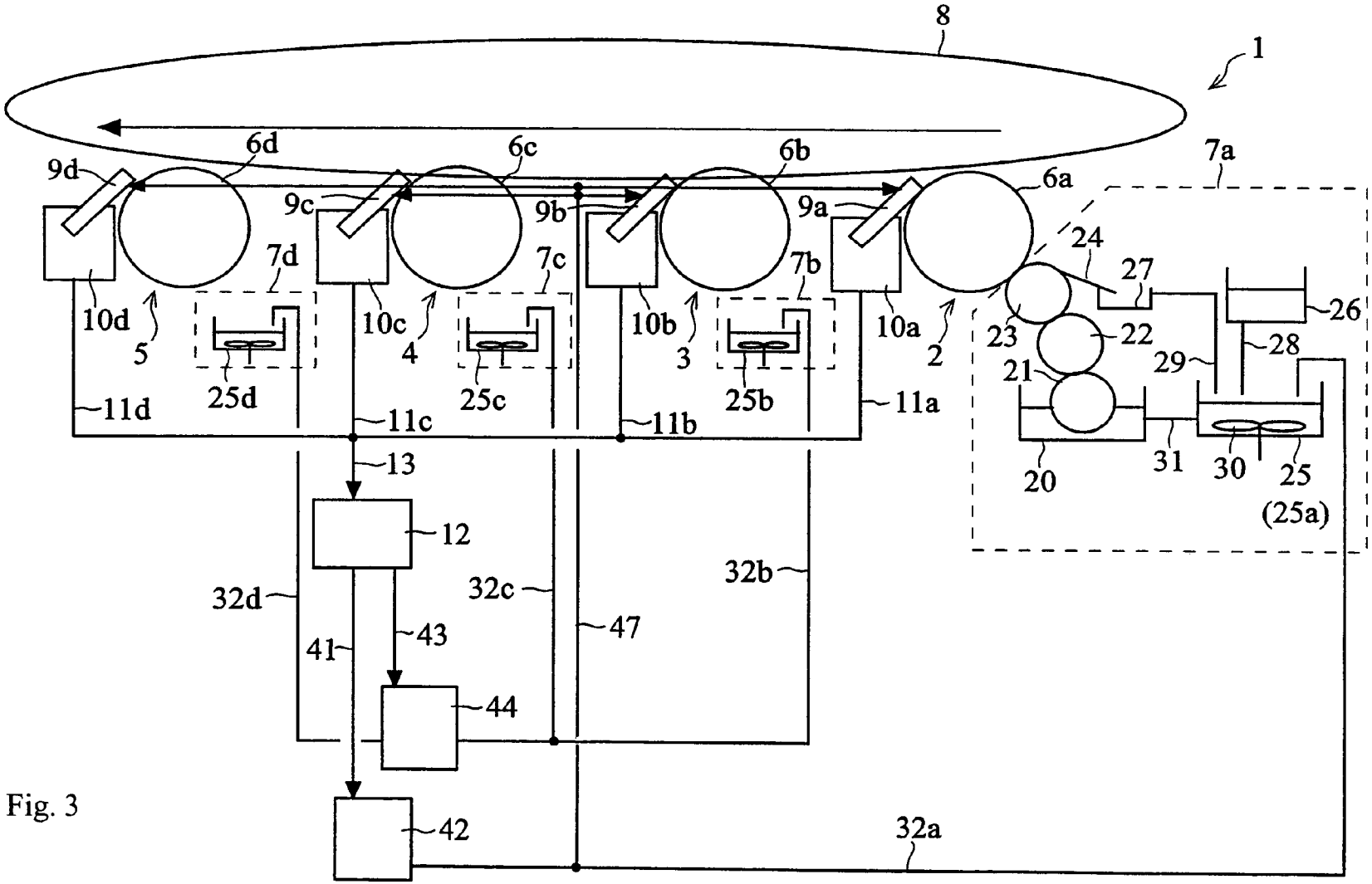
FIG. 3 is a schematic diagram showing configuration of a wet image forming apparatus according to a second embodiment of the invention.

A wet image forming apparatus according to the second embodiment of the invention will be described with reference to FIG. 3. FIG. 3 is a pattern diagram showing configuration of the wet image forming apparatus according to the second embodiment of the invention. In FIG. 3, components configured in the same manner as those of FIG. 1 described above are provided with the same reference numerals used in FIG. 1, and thus omitted from the description.

Referring to FIG. 3, the wet image forming apparatus according to the second embodiment of the invention has a major difference from the wet image forming apparatus according to the first embodiment of the invention shown in FIG. 1 in that a carrier liquid stored in a first carrier liquid pot 42 is used not only for concentration control of a yellow liquid developer but also for cleaning of photoconductive drum collecting blades 9*a*, 9*b*, 9*c*, and 9*d*.

Specifically, it is configured such that a carrier liquid is supplied to the photoconductive drum collecting blades 91, 9*b*, 9*c*, and 9*d* through a cleaning agent supply path 47 diverging from a carrier liquid conveyance path 32*a*. As a result, the photoconductive drum collecting blades 91, 9*b*, 9*c*, and 9*d* are satisfactorily cleaned by using a carrier liquid of particularly high purity with an impurity concentration of 0.1% or less.

Third Embodiment

Figure 4:
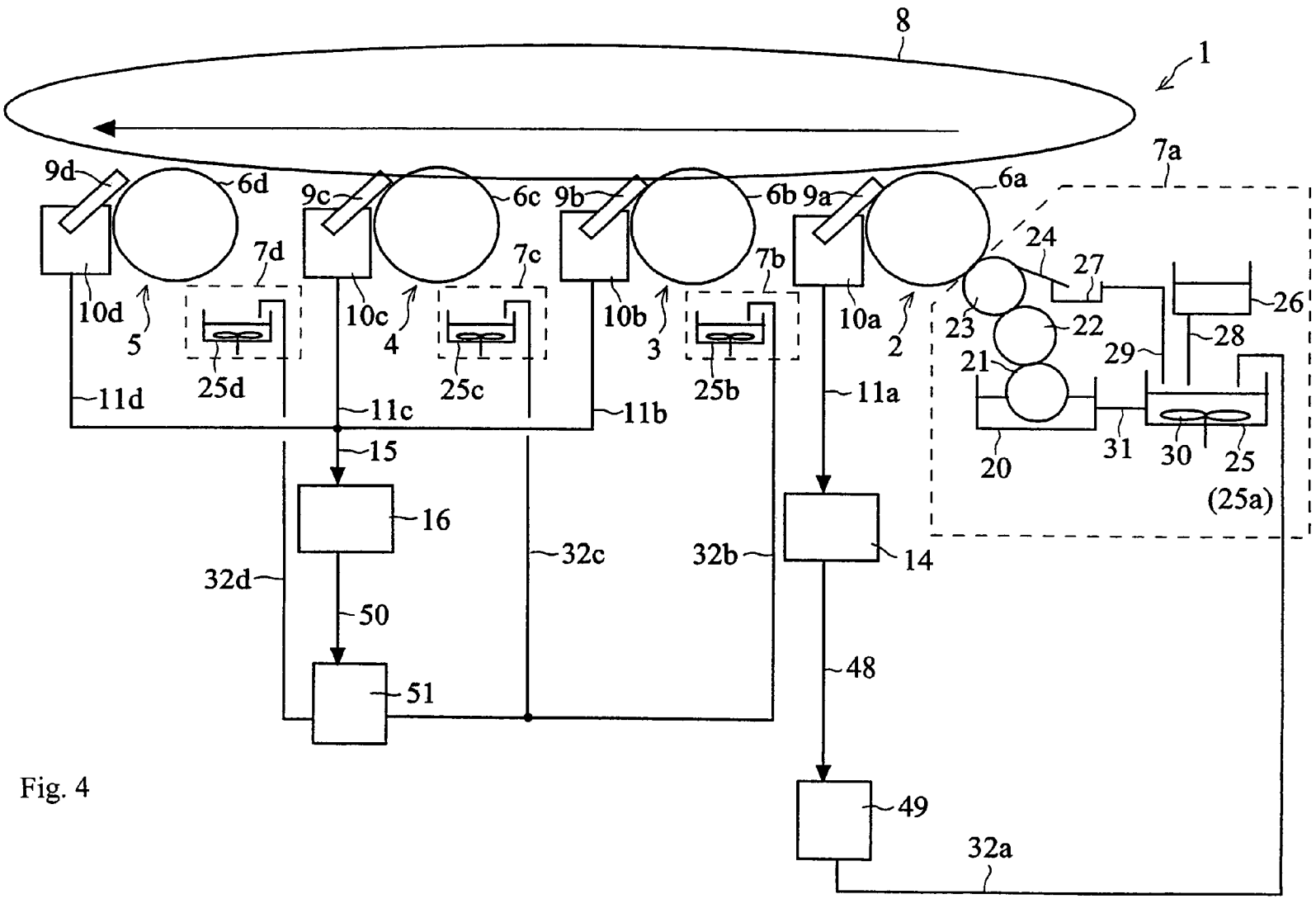
FIG. 4 is a schematic diagram showing configuration of a wet image forming apparatus according to a third embodiment of the invention.
Figure 5:
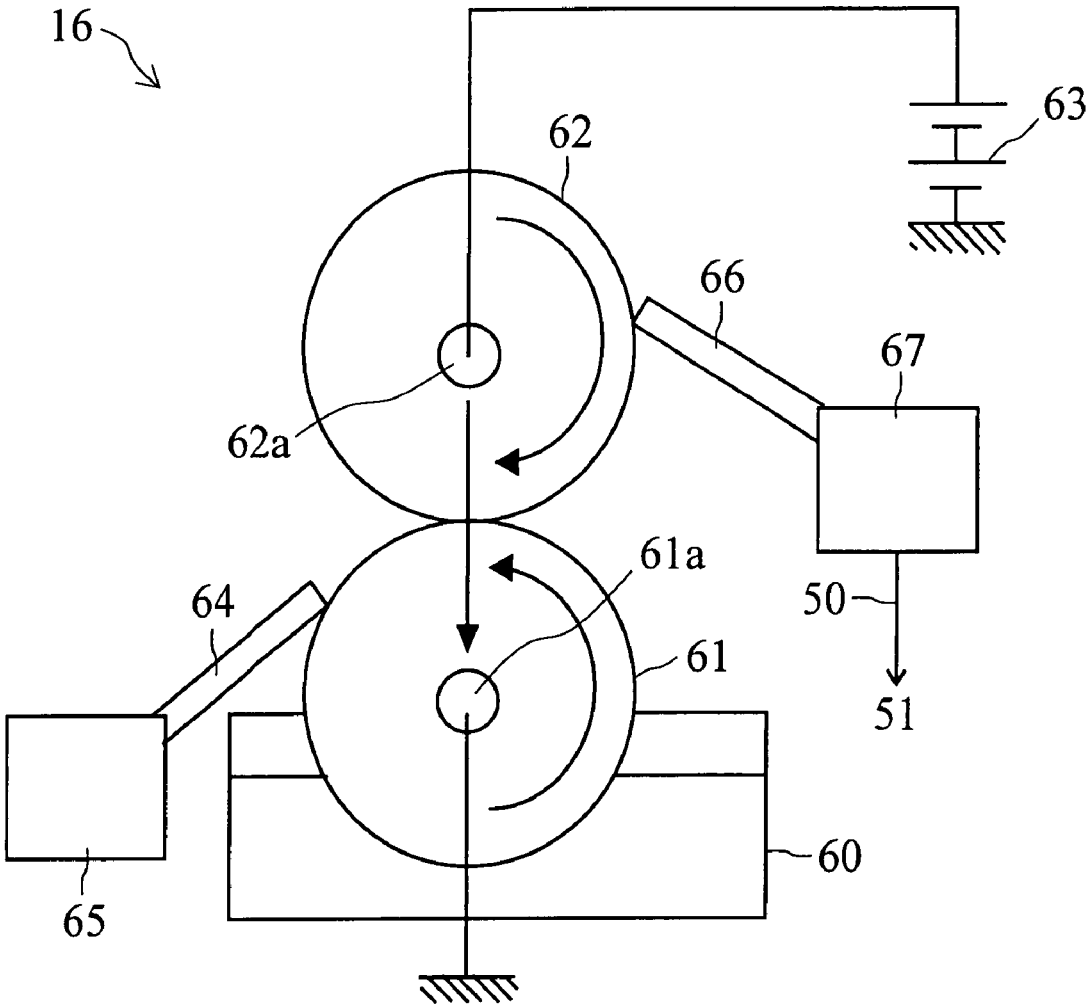
FIG. 5 is a schematic diagram showing configuration of a second carrier liquid extracting device of the wet image forming apparatus according to the third embodiment of the invention.

Next, the third embodiment of the invention will be described with reference to FIGS. 4 and 5. FIG. 4 is a pattern diagram showing configuration of a wet image forming apparatus according to the third embodiment of the invention. FIG. 5 is a schematic diagram showing configuration of a second carrier liquid extracting device of the wet image forming apparatus according to the third embodiment of the invention shown in FIG. 4. In FIGS. 4 and 5, components configured in the same manner as those of FIGS. 1 and 2A are provided with the same reference numerals as those used in FIGS. 1 and 2A and thus omitted from the description.

In the third embodiment of the invention, an yellow toner image, a cyan toner image, a magenta toner image, and a black toner image are sequentially transferred onto an intermediate transfer belt 8 in such a manner as to be superimposed on one another. That is, in this embodiment, the image formed on a yellow photoconductive drum 6*a* is first transferred onto the intermediate transfer belt 8, which can prevents, as much as possible, a collected liquid developer stored in a yellow collecting box 10*a* from being mixed with liquid developers of the other colors.

A carrier liquid extracted from the used yellow liquid developer is supplied to a preparation pot 25*a* of a yellow liquid developing device 7*a*. On the other hand, carrier liquids extracted from the used cyan, magenta, and black_liquid developers are supplied to preparation pots 25*b*, 25*c*, and 25*d* of cyan, magenta, and black liquid developing devices 7*b*, 7*c*, and 7*d*.

More specifically, the liquid developers of the different colors respectively collected in cyan, magenta, and black collecting boxes 10*b*, 10*c*, and 10*d* pass through conveyance paths 11*b*, 11*c*, and 11*d*, then are merged together into an assembly path 15, and then supplied to the second carrier liquid extracting device 16 while all kept mixed together. A carrier liquid extracted from the second carrier liquid extracting device 16 is conveyed to a second carrier liquid pot 51 through a conveyance path 11*a* and then stored in the second carrier liquid pot 51. On the other hand, the yellow liquid developer collected in the yellow collecting box 10*a* passes through a conveyance path 11*a,* and then is supplied to a first carrier liquid extracting device 14. A carrier liquid extracted from the first carrier liquid extracting device 14 is conveyed to a first carrier liquid pot 49 through a conveyance path 48 and then stored in the first carrier liquid pot 49.

The first carrier liquid pot 49 is connected to the preparation pot 25*a* of the yellow liquid developing device 7*a* via a carrier liquid conveyance path 32*a*, so that the carrier liquid stored in the first carrier liquid pot 49 is supplied to the yellow preparation pot 25*a*. On the other hand, the second carrier liquid pot 51 is connected to the cyan, magenta, and black preparation pots 25*b*, 25*c*, and 25*d* via a carrier liquid conveyance path 32*b*, a carrier liquid conveyance path 32*c*, and a carrier liquid conveyance path 32*d*, respectively, so that the carrier liquid stored in the second carrier liquid pot 51 is supplied to the cyan, magenta, and black preparation pots 25*b*, 25*c*, and 25*b*.

Of the liquid developers of the four colors described above, the yellow liquid developer is susceptible to the influence of the toners of the other colors. On the contrary, the liquid developers of the other colors, that is, cyan, magenta, and black are less susceptible to the influence of the toners of the other colors; thus, use of the carrier liquid extracted from the liquid developer of any of these colors for concentration control of these liquid developers has little influence on the image quality. Therefore, the carrier liquid extracted from the yellow liquid developer can be used for the concentration control of the yellow liquid developer while the carrier liquid extracted from the liquid developer obtained by mixing together cyan, magenta, and black can be used for the concentration control of the liquid developers of the other colors excluding yellow to thereby provide an image of favorable quality.

FIG. 5 is a schematic diagram showing configuration of the second carrier liquid extracting device 16 of the wet image forming apparatus according to the third embodiment of the invention. The second carrier liquid extracting device shown in FIG. 5 differs from the carrier liquid extracting device shown in FIG. 2A in that the second carrier liquid extracting device 16 is not provided with an impurity concentration sensor for measuring the impurity concentration of a liquid developer, although employing an extraction method configured in the same manner as that employed by the carrier liquid extracting device shown in FIG. 2A. That is, the liquid developers respectively collected from the collecting boxes 10*b,* 10*c,* and 10*d* are separated into a carrier liquid and toner particles by a lower roller 61 and an upper roller 62, and then the carrier liquid is collected in the carrier liquid box 67. The carrier liquid stored in the carrier liquid box 67 is supplied to the second carrier liquid pot 51 through a conveyance path 50. The first carrier liquid extracting device 14 according to this embodiment has the same configuration as that of the second carrier liquid extracting device 16 and thus is omitted from the description.

As described above, according to the third embodiment of the invention, the carrier liquid extracted from the yellow liquid developer is used for the concentration control of the yellow liquid developer susceptible to the influence of the other colors, and the carrier liquid extracted from the liquid developer obtained by mixing together black, cyan, and magenta is used for the concentration control of the liquid developers of the other colors excluding yellow. This permits efficient use of the carrier liquids to be recycled without having an influence on the image quality.

In the third embodiment of the invention, the image formed on the yellow photoconductive drum 6*a* is first transferred onto the intermediate transfer belt 8, so that the collected yellow liquid developer is less likely to be mixed with the liquid developers of the other colors. This can prevent, as much as possible, the carrier liquid used for the concentration control of the yellow liquid developer from being mixed with the toner particles of the other colors, which in turn can reliably prevent influence on the image quality.

Fourth Embodiment

Figure 6:
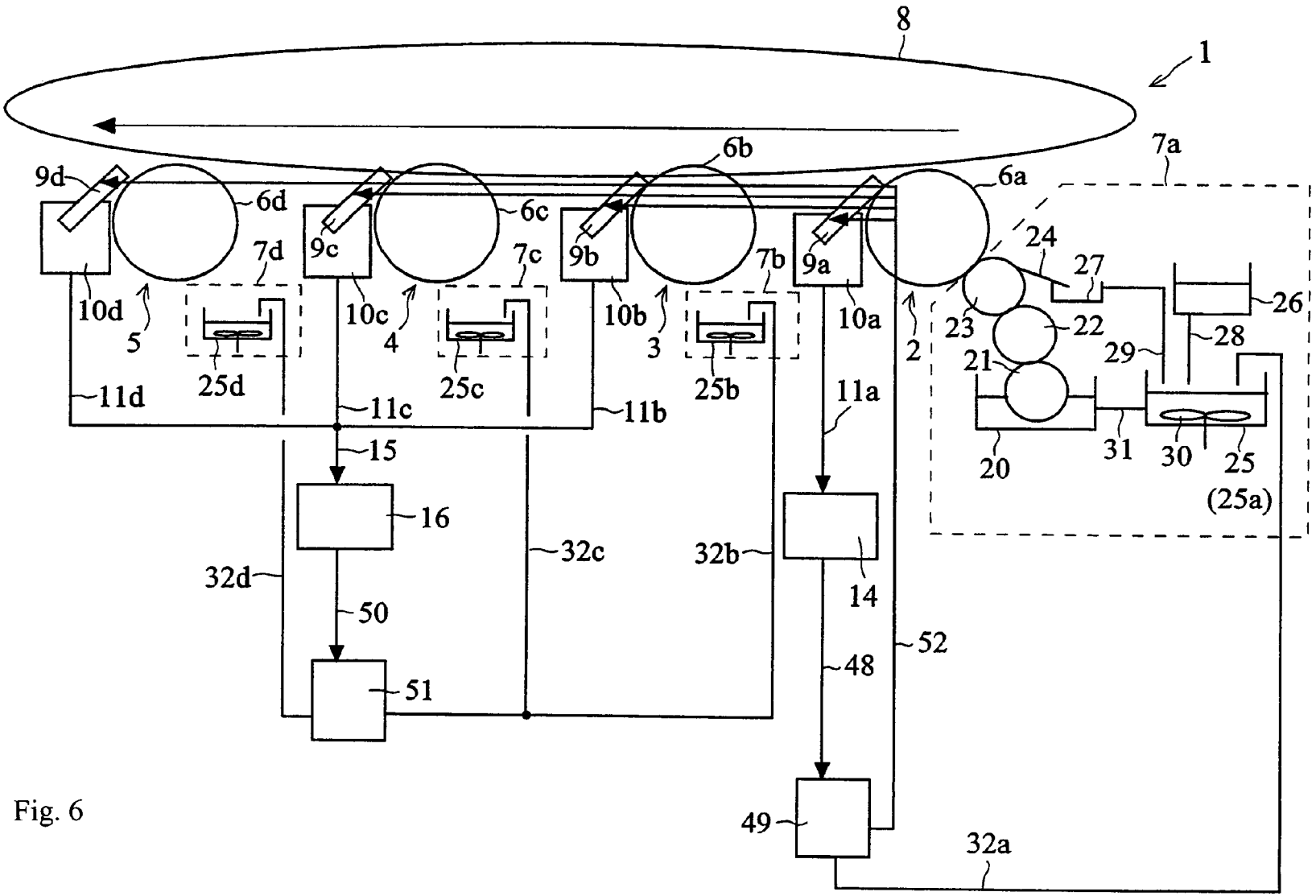
FIG. 6 is a schematic diagram showing configuration of a wet image forming apparatus according to a fourth embodiment of the invention.

The fourth embodiment of the invention will be described in detail with reference to FIG. 6. FIG. 6 is a pattern diagram showing configuration of a wet image forming apparatus according to the fourth embodiment of the invention. Components of FIG. 6 configured in the same manner as those of FIG. 4 are provided with the same reference numerals and thus omitted from the description.

Referring to FIG. 6, the fourth embodiment of the invention differs from the third embodiment of the invention in that a carrier liquid stored in a first carrier liquid pot 49 is used not only for control of a yellow liquid developer but also for cleaning of photoconductive drum collecting blades 9*a*, 9*b*, 9*c*, and 9*d*. It is configured such that a carrier liquid is fed to each of the photoconductive drum collecting blades 9*a*, 9*b*, 9*c*, and 9*d* through a cleaning agent supply path 52 diverging from a carrier liquid conveyance path 32*a*. As a result, the photoconductive drum collecting blades 9*a*, 9*b*, 9*c*, and 9*d* are cleaned satisfactorily.

The invention is not limited to the embodiments described above, and thus any modification can be made thereto within a range described in the scope of claims.

For example, in the first to fourth embodiments described above, it is configured such that only the carrier liquids to be recycled are supplied to the preparation pots 25 (25*a* to 25*d*). However, a carrier liquid tank storing a new carrier liquid may be connected to the preparation pots 25 (25*a* to 25*d*) so that not only the carrier liquids to be recycled but also the new carrier liquid can be supplied thereto.

In the first and second embodiments of the invention, it is configured such that, of the carrier liquids extracted from the carrier liquid extracting device 12, the carrier liquid having an impurity concentration of 0.1% or less is used for the concentration control of the yellow liquid developer or for the cleaning of the photoconductive drum collecting blades 9*a*, 9*b*, 9*c*, and 9*d*. However, the carrier liquid having an impurity concentration of 0.1% or less may be used not only for the concentration control of the yellow liquid developer but also for the concentration control of the liquid developers of the colors other than yellow, i.e., cyan, magenta, and black.

In the first and second embodiments, it is configured such that, of the carrier liquids extracted from the carrier liquid extracting device 12, the carrier liquid of a little lower purity, for example, the carrier liquid having an impurity concentration of between 0.1% exclusive and 0.5% inclusive is used for the concentration control of the cyan, magenta, and black liquid developers less susceptible to the influence of the other colors. However, it may also be configured such that this carrier liquid is not only used for the concentration control of the cyan, magenta, and black liquid developers less susceptible to the influence of the other colors but also for the cleaning of the intermediate transfer belt 8.

In the first and second embodiments of the invention, it is configured such that, of the carrier liquids extracted from the carrier liquid extracting device 12, the carrier liquid having an impurity concentration of 0.1% or less is used for the concentration control of the yellow liquid developer or for the cleaning of the photoconductive drum collecting blades 9*a*, 9*b*, 9*c*, and 9*d*. The invention is not limited to this, and it may be configured such that the carrier liquid having an impurity concentration of 0.05% or less is used for the concentration control of the yellow liquid developer or for the cleaning of the photoconductive drum collecting blades 9*a*, 9*b*, 9*c*, and 9*d*.

In the third and fourth embodiments of the invention, it is configured such that the carrier liquid extracted from the yellow carrier liquid extracting device (first carrier liquid extracting device), which extracts the carrier liquid from the yellow liquid developer, is recycled for the concentration control of the yellow liquid developer. However, it may be configured such that the yellow carrier liquid extracted from the yellow carrier liquid extracting device (first carrier liquid extracting device) is not only used for the concentration control of the yellow liquid developer but also recycled for the concentration control of the liquid developers of the colors other than yellow, i.e., cyan, magenta, and black.

In the third and fourth embodiments described above, it is configured such that the carrier liquid extracted from the second carrier liquid extracting device, which extracts the carrier liquid from the liquid developers of the other colors excluding yellow, is used for the concentration control of the cyan, magenta, and black liquid developers less susceptible to the influence of the other colors. However, it may be configured such that this carrier liquid is used not only for the concentration control of the cyan, magenta, and black liquid developers less susceptible to the influence of the other colors but also for the cleaning of the intermediate transfer belt 8.

The third and fourth embodiments of the invention described above have been described, referring to the intermediate transfer belt type wet image forming apparatus in which toner images are temporarily transferred onto the intermediate transfer belt 8 and then secondarily transferred onto paper. However, the invention is not limited to this; thus, the images may be fixed directly onto the paper. Also in this case, the yellow toner image, the cyan toner image, the magenta toner image, and the black toner image are sequentially transferred in such a manner as to be superimposed on one another.

Hereinafter, the invention will be described in more detail, referring to examples, although the invention is not limited thereto.

[Method of Producing a Liquid Developer]

A ground toner having an average power diameter of 7 μm, 80% of polyester resin, and a pigment concentration of 20%, a dispersant, zirconium naphthenate (produced by Nihon Kagaku Sangyo Co. Ltd.), and a carrier liquid (Isoper G produced by Exon Mobil Ltd.) are mixed together in the ratio of 35:2:1:62 and agitated sufficiently, and then the mixture is subjected to wet dispersion in a Beads mill (produced by Shinmaru Enterprises Corporation). Subsequently, the carrier liquid is diluted, thereby producing a liquid developer having a toner particle concentration of 20%.

EXAMPLES 1 TO 3

By using a carrier liquid extracting device configured in the same manner as the carrier liquid extracting device shown in FIG. 2A and by using as a diluting carrier liquid a carrier liquid having an impurity concentration of 0.46% extracted from a liquid developer and using black, cyan, and magenta ground toners, liquid developers of the different colors are produced through the method of producing a liquid developer described above. Example 1 refers to the black liquid developer obtained. Example 2 refers to the cyan liquid developer obtained. Example 3 refers to the magenta liquid developer obtained.

EXAMPLE 4

By using as a diluting carrier liquid a carrier liquid having an impurity concentration of 0.05% extracted in the same method as the method used in Example 1 and using a yellow ground toner, a yellow liquid developer is produced through the method of producing a liquid developer described above. Example 4 refers to the yellow liquid developer obtained.

COMPARATIVE EXAMPLES 1 TO 4

By using a ground toner of any one of black, cyan, magenta, and yellow colors and using as a diluting carrier liquid a pure carrier liquid (Isoper-G produced by Exon Mobile Ltd.), liquid developers of the different colors are produced through the method of producing a liquid developer described above. Comparative Example 1 refers to the black liquid developer obtained. Comparative Example 2 refers to the cyan liquid developer obtained. Comparative Example 3 refers to the magenta liquid developer obtained. Comparative Example 4 refers to the yellow liquid developer obtained.

COMPARATIVE EXAMPLES 5 TO 7

By using as a diluting carrier liquid a carrier liquid having an impurity concentration of 0.53% extracted in the same manner as that used in Example 1 and using black, cyan, and magenta ground toners, liquid developers of the different colors are produced through the method of producing a liquid developer described above. Comparative Example 5 refers to the black liquid developer obtained. Comparative Example 6 refers to the cyan liquid developer obtained. Comparative Example 7 refers to the magenta liquid developer obtained.

COMPARATIVE EXAMPLE 8

By using as a diluting carrier liquid a carrier liquid having an impurity concentration of 0.46% extracted in the same manner as that used in Example 1 and using a yellow ground toner, an yellow liquid developer is produced through the method of producing a liquid developer described above. Comparative Example 8 refers to the yellow liquid developer obtained.

EXAMPLES 5 TO 7

By using as a diluting carrier liquid a carrier liquid extracted from the used black, cyan, and magenta liquid developers by use of the carrier liquid extracting device configured in the same manner as the carrier liquid extracting device shown in FIG. 5 and using black, cyan, magenta ground toners, liquid developers of the different colors are produced through the method of producing a liquid developer described above. Example 5 refers to the black liquid developer obtained. Example 6 refers to the cyan liquid developer obtained. Example 7 refers to the magenta liquid developer obtained.

EXAMPLE 8

By using as a diluting carrier liquid a carrier liquid extracted from the used yellow liquid developer by use of the carrier liquid extracting device configured in the same manner as the carrier liquid extracting device shown in FIG. 5 and using a yellow ground toner, a yellow liquid developer is produced through the method of producing a liquid developer described above. Example 8 refers to the yellow liquid developer obtained.

COMPARATIVE EXAMPLE 9

By using as a diluting carrier liquid a carrier liquid extracted from the used black, cyan, magenta, and yellow liquid developers by use of the carrier liquid extracting device configured in the same manner as the carrier liquid extracting device shown in FIG. 5 and using a yellow ground toner, a yellow liquid developer is produced through the method of producing a liquid developer described above. Comparative Example 9 refers to the yellow liquid developer obtained.

[Test Method]

Image formation was performed by using the liquid developers of Examples 1 to 8 described above and using the liquid developers of Comparative Examples 1 to 9, and then the colors obtained were measured with a spectrometer (manufactured by Gretagmacbeth Co. Ltd.).

[Test Results]

Table 1 shows the measurement results in the color space L*A*B* according to the CIE, where L* denotes brightness, A* denotes balance between red and green, and B* denotes balance between yellow and blue. ⊿E denotes color difference obtained through comparison between Examples 1 to 8 and Comparative Examples 5 to 8, and Comparative Examples 1 to 4 as pure carrier liquids ($L^*_0$, $A^*_0$, and $B^*_0$), and is expressed by formula below. Values of less than 3.0 for ⊿E show almost no color difference, leading to judgment that there is no image quality difference.

$$\Delta E=[(L^*-L^*_0)^2+(A^*-A^*_0)^2+(B^*-B^*_0)^2]^{1/2}$$

As shown in Table 1, Examples 1, 2, and 3 referring to the black, cyan, and magenta liquid developers diluted by using the carrier liquid having an impurity concentration of 0.46% provided more favorable image quality at the time of image formation than Comparative Examples 5, 6, and 7 referring to the black, cyan, and magenta liquid developers subjected to concentration control using the carrier liquid having an impurity concentration of 0.53%.

On the other hand, Comparative Example 8 referring to the yellow liquid developer diluted by using the carrier liquid having an impurity concentration of 0.46%, the same value as that in Examples 1 to 3, provided greatly deteriorated image quality at the time of image formation. On the contrary, Example 4 referring to the yellow liquid developer diluted by using the carrier liquid having an impurity concentration of 0.05% provided favorable image quality at the time of image formation.

As shown in Table 2, Examples 5, 6, and 7 referring to the black, cyan, and magenta liquid developers diluted by using the carrier liquid extracted from the liquid developer obtained by mixing together the three colors black, cyan, and magenta excluding yellow provided favorable image quality at the time of image formation.

Example 8 referring to the yellow liquid developer diluted by using the carrier liquid extracted from the yellow liquid developer provided extremely favorable image quality at the time of image formation, compared to Example 9 referring to the yellow liquid developer diluted by using the carrier liquid extracted from the liquid developer obtained by mixing together the four colors, black, cyan, magenta, and yellow.

The embodiments, Examples, and the like described in detail above just clarify the contents of technologies provided by the invention. Therefore, the invention should not be interpreted in a narrow sense limited to the detailed examples, and thus it should be understood that various modifications can be made to the invention within the range of the appended claims.

TABLE 1

| | Colors | L* | A* | B* | ⊿E |
|---|---|---|---|---|---|
| Comparative Example 1 | Black | 30.51 | 0.63 | −0.11 | — |
| Comparative Example 2 | Cyan | 58.72 | −27.17 | −46.33 | — |
| Comparative Example 3 | Magenta | 54.49 | 69.28 | 1.16 | — |
| Comparative Example 4 | Yellow | 90.52 | −5.48 | 89.01 | — |
| Comparative Example 5 | Black | 32.01 | 0.63 | −0.11 | 1.5 |
| Comparative Example 6 | Cyan | 57.22 | −26.36 | −43.57 | 3.2 |
| Comparative Example 7 | Magenta | 51.96 | 67.76 | 0.11 | 3.1 |
| Comparative Example 8 | Yellow | 79.32 | −4.83 | 70.33 | 21.8 |
| Example 1 | Black | 30.87 | 0.65 | −0.12 | 0.4 |
| Example 2 | Cyan | 59.08 | −27.05 | −45.99 | 0.5 |
| Example 3 | Magenta | 54.48 | 69.52 | 0.62 | 0.6 |
| Example 4 | Yellow | 88.96 | −6.22 | 88.75 | 1.7 |

TABLE 2

| | Colors | L* | A* | B* | ⊿E |
|---|---|---|---|---|---|
| Comparative Example 1 | Black | 30.51 | 0.63 | −0.11 | — |
| Comparative Example 2 | Cyan | 58.72 | −27.17 | −46.33 | — |
| Comparative Example 3 | Magenta | 54.49 | 69.28 | 1.16 | — |
| Comparative Example 4 | Yellow | 90.52 | −5.48 | 89.01 | — |
| Comparative Example 9 | Yellow | 82.13 | −4.98 | 75.30 | 16.1 |
| Example 5 | Black | 31.16 | 0.67 | −0.06 | 0.7 |
| Example 6 | Cyan | 57.82 | −27.53 | −45.98 | 0.5 |
| Example 7 | Magenta | 54.77 | 69.13 | 0.73 | 0.5 |
| Example 8 | Yellow | 90.76 | −5.65 | 87.12 | 1.9 |

What is claimed is:

1. A wet image forming apparatus including a plurality of photoconductors and forming, by using liquid developers of a plurality of colors, images of the mutually different colors on the respective photoconductors, the wet image forming apparatus comprising:

a plurality of collectors for collecting the liquid developers remaining on the respective photoconductors;

a carrier liquid extracting device for extracting a carrier liquid from a liquid developer obtained by mixing together all the liquid developers collected by the plurality of collectors; and a carrier liquid purity detector for detecting purity of the carrier liquid extracted by the carrier liquid extracting device, wherein based on the purity detected by the carrier liquid purity detector, the carrier liquid extracted by the carrier liquid extracting device is recycled as a carrier liquid for concentration control of the liquid developers, or as a carrier liquid for cleaning of a member, the carrier liquid extracted by the carrier liquid extracting device being used for the cleaning of the member if the purity detected by the carrier liquid purity detector is equal to or larger than a predetermined value, and being used for the concentration control if the purity detected by the carrier liquid purity detector is less than the predetermined value.

2. A wet image forming apparatus including a plurality of photoconductors and forming, by using liquid developers of a plurality of colors including yellow, images of the mutually different colors on the respective photoconductors and then sequentially superimposing the images of the plurality of colors on one another to thereby achieve image formation, the wet image forming apparatus comprising:

a plurality of collectors for collecting the liquid developers remaining on the respective photoconductors;

a first carrier liquid extracting device for extracting a carrier liquid from the yellow liquid developer collected from the yellow photoconductor included in the photoconductors; and a second carrier liquid extracting device for extracting a carrier liquid from the liquid developers collected from the photoconductors of all the other colors excluding the yellow photoconductor, wherein the carrier liquid extracted by the first carrier liquid extracting device is recycled for concentration control of the liquid developers, and the carrier liquid extracted by the second carrier liquid extracting device is recycled for concentration control of the liquid developers of the other colors excluding yellow.

3. The wet image forming apparatus according to claim 2, wherein the carrier liquid extracted by the first carrier liquid extracting device is recycled for the concentration control of the yellow liquid developer only.

4. The wet image forming apparatus according to claim 2, wherein the image formed on the yellow photoconductor is transferred onto the photoconductor earlier than the images formed on the other photoconductors.

5. A wet image forming apparatus including a plurality of photoconductors and forming, by using liquid developers of a plurality of colors including yellow, images of the mutually different colors on the respective photoconductors and then sequentially superimposing the images of the plurality of colors on one another to thereby achieve image formation, the wet image forming apparatus comprising:

a plurality of collectors for collecting the liquid developers remaining on the respective photoconductors;

a first carrier liquid extracting device for extracting a carrier liquid from the yellow liquid developer collected from the yellow photoconductor included in the photoconductors; and a second carrier liquid extracting device for extracting a carrier liquid from the liquid developers collected from the photoconductors of all the other colors excluding the yellow photoconductor, wherein the carrier liquid extracted by the first carrier liquid extracting device is used and recycled for concentration control of the liquid developers used for cleaning of a member, and the carrier liquid extracted by the second carrier liquid extracting device is recycled for concentration control of the liquid developers of the other colors excluding yellow.

6. The wet image forming apparatus according to claim 5, wherein, when the carrier liquid extracted by the first carrier liquid extracting device is recycled for the concentration control of the liquid developers, the carrier liquid extracted by the first carrier liquid extracting device is recycled for the concentration control of the yellow liquid developer only.

7. The wet image forming apparatus according to claim 5, wherein the image formed on the yellow photoconductor is transferred onto the photoconductor earlier than the images formed on the other photoconductors.

* * * * *